US009539594B2

(12) United States Patent
Seiz et al.

(10) Patent No.: US 9,539,594 B2
(45) Date of Patent: Jan. 10, 2017

(54) ATOMIZER WITH A LATTICE MIXER

(75) Inventors: Bernhard Seiz, Lauffen (DE); Frank Herre, Oberriexingen (DE); Michael Baumann, Flein (DE)

(73) Assignee: Duerr Systems GmbH, Bietigheim-Bissingen (DE)

( * ) Notice: Subject to any disclaimer, the term of this patent is extended or adjusted under 35 U.S.C. 154(b) by 687 days.

(21) Appl. No.: 13/696,460

(22) PCT Filed: May 4, 2011

(86) PCT No.: PCT/EP2011/002228

§ 371 (c)(1),
(2), (4) Date: Dec. 3, 2012

(87) PCT Pub. No.: WO2011/138028

PCT Pub. Date: Nov. 10, 2011

(65) Prior Publication Data

US 2015/0122915 A1 May 7, 2015

(30) Foreign Application Priority Data

May 7, 2010 (DE) ..... 10 2010 019 771

(51) Int. Cl.
*B05B 7/04* (2006.01)
*B01F 5/06* (2006.01)
(Continued)

(52) U.S. Cl.
CPC ..... *B05B 7/0408* (2013.01); *B01F 5/0605* (2013.01); *B01F 5/0619* (2013.01); *B05B 3/10* (2013.01); *B05B 12/1418* (2013.01)

(58) Field of Classification Search
CPC .... B05B 3/035; B05B 15/0275; B05B 15/002; B05B 7/0408; B05B 7/2489; B05B 7/2497; B05B 7/2408; B05B 7/04; Y10S 366/605; B29B 7/7438; B44D 3/06; B44D 3/08; B01F 5/0602; B01F 5/10; B01F 5/06; B01F 5/0605; B01F 5/0619
(Continued)

(56) References Cited

U.S. PATENT DOCUMENTS 4,093,188 A * 6/1978 Horner ..... B01F 3/10 366/336
4,232,832 A * 11/1980 De Fusco ..... B05B 5/03 239/417.5
(Continued)

FOREIGN PATENT DOCUMENTS

CN 1140098 A 1/1997
DE 3040136 A1 6/1982
(Continued)

OTHER PUBLICATIONS

European Patent Office, International Search Report, PCT/EP2011/002228; Jul. 11, 2011, 6 pages with English Translation.

*Primary Examiner* — Arthur O Hall
*Assistant Examiner* — Joseph A Greenlund
(74) *Attorney, Agent, or Firm* — Bejin Bieneman PLC

(57) ABSTRACT

An atomizer comprises a static mixer configured to mix components of a coating agent with one another. The mixer has a plurality of fixed mixing elements and is constructionally integrated into the atomizer, and the mixer is a lattice mixer having mixing elements that are arranged intertwined in a lattice-like manner.

15 Claims, 3 Drawing Sheets

Figure 1:
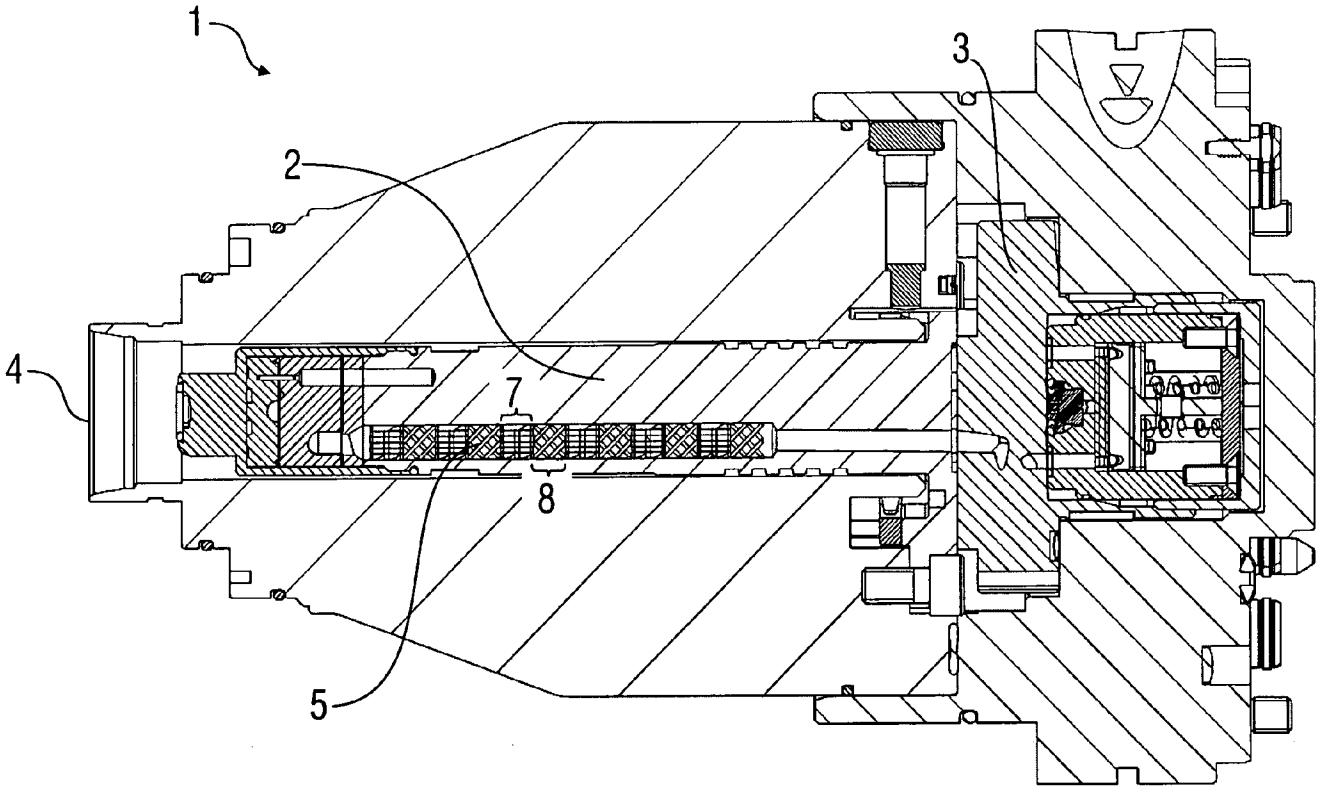

(51) Int. Cl.
*B05B 3/10* (2006.01)
*B05B 12/14* (2006.01)

(58) Field of Classification Search
USPC ..... 239/432, 112, 413, 142, 417.5; 366/337, 366/338, 339; 118/679; 222/142.5, 222/135.5–145.8
See application file for complete search history.

(56) References Cited

U.S. PATENT DOCUMENTS 4,518,119 A * 5/1985 Vetter ..... B05B 3/1014 239/223
4,614,440 A 9/1986 Behr
4,667,878 A * 5/1987 Behr ..... B05B 1/3046 239/125
5,462,204 A * 10/1995 Finn ..... B05B 1/3066 222/137
5,520,460 A * 5/1996 Lantz ..... B01F 5/0602 29/469
5,620,252 A * 4/1997 Maurer ..... B01F 5/0619 366/337
6,010,084 A * 1/2000 Yoshida ..... B05B 3/1064 239/112
6,027,241 A * 2/2000 King ..... B01F 3/0873 138/38
6,135,631 A * 10/2000 Keller ..... B01F 5/0615 222/145.6
6,375,096 B1 * 4/2002 Rashidi ..... B01F 13/002 239/413
6,585,407 B2 7/2003 Koch
6,595,679 B2 * 7/2003 Schuchardt ..... B01F 5/0619 366/147
6,637,928 B2 * 10/2003 Schuchardt ..... B29B 7/325 366/337
6,769,574 B1 * 8/2004 Keller ..... B05C 17/00509 222/137
6,769,801 B1 * 8/2004 Maurer ..... B29C 45/581 366/337
6,773,156 B2 * 8/2004 Henning ..... B29C 47/362 366/337
7,040,802 B2 * 5/2006 Fuglister ..... B01F 5/0618 366/337
7,438,464 B2 * 10/2008 Moser ..... B01F 5/0612 366/336
7,559,440 B2 * 7/2009 Rueschhoff ..... B05B 1/3066 222/145.5
7,717,357 B2 * 5/2010 Gantenbein ..... B01F 5/0619 222/145.6
8,025,026 B2 * 9/2011 Le Strat ..... B05B 5/1625 118/302
8,322,632 B2 * 12/2012 Walter ..... B01F 5/0256 239/396
8,567,694 B2 * 10/2013 Herre ..... G01M 99/008 239/71
8,672,188 B2 * 3/2014 Rotz ..... B01F 5/0615 141/346
8,969,638 B2 * 3/2015 Tippet ..... B01J 8/062 201/25
9,079,197 B2 * 7/2015 Bina ..... B05B 7/0408
2003/0165080 A1 * 9/2003 Pinyayev ..... B01F 5/0619 366/337
2004/0114461 A1 * 6/2004 Fuglister ..... B01F 5/0618 366/337
2005/0035220 A1 * 2/2005 Brown ..... B29B 7/7438 239/432
2005/0094482 A1 * 5/2005 Foster, Jr. ..... B01F 3/04453 366/101
2005/0232073 A1 * 10/2005 Wagner ..... A61C 5/064 366/172.1
2006/0192033 A1 8/2006 Dansizen et al.
2006/0208000 A1 * 9/2006 Murray ..... B29B 7/7404 222/135
2006/0219816 A1 * 10/2006 Herre ..... B05B 3/1014 239/451
2008/0179554 A1 * 7/2008 Finn ..... B01F 5/0619 251/122
2008/0203112 A1 * 8/2008 Peuker ..... A61O 5/062 222/137
2008/0203115 A1 * 8/2008 LaFlamme et al. ..... 222/207
2008/0210771 A1 * 9/2008 Zarzalis ..... B05B 7/0475 239/58
2008/0230003 A1 9/2008 LeStrat et al.
2008/0249200 A1 * 10/2008 Yokoyama ..... C08G 63/88 521/48
2009/0277378 A1 * 11/2009 Yamauchi ..... B05B 3/10 118/300
2010/0093932 A1 * 4/2010 Rempel ..... B01F 5/0619 525/52
2012/0106290 A1 * 5/2012 Meijer ..... B01F 3/0861 366/337
2014/0151462 A1 * 6/2014 Yamauchi ..... B05B 15/02 239/112

FOREIGN PATENT DOCUMENTS

DE 8231663 U1 8/1983
DE EP 0104395 A2 * 4/1984 ..... B05B 5/04
DE 4321873 A1 3/1994
EP 0104395 A2 4/1984
EP 1149626 A1 10/2001
FR 2890876 A1 3/2007
WO 0226368 A2 4/2002
WO WO2008136827 A1 11/2008

* cited by examiner

ATOMIZER WITH A LATTICE MIXER

An atomizer, particularly a rotary atomizer for the application of a coating agent consists of a plurality of components.

In modern painting installations for painting of motor vehicle body components, rotary atomizers are conventionally used as application devices that to some extent can also apply multi-components paints which consist of a plurality of coating agent components, such as for example a base paint and a hardener. It is important here that the various components of the multi-component paint are mixed with one another as well as possible in the atomizer. To this end, the conventional rotary atomizers have static helical mixers which are also designated as Kenics® mixers. These helical mixers have numerous spiral mixing elements which direct the coating agent flow radially outwards and then lead to the centre again. Usually, two separate helical mixers are used here, wherein the first helical mixer is arranged in the paint tube of the rotary atomizer, whilst the second helical mixer is located outside of the paint tube in the connection block of the rotary atomizer.

The disadvantage of this conventional design is the fact that a relatively large overall length of the mixer is required, so that in the case of a colour change or in the case of rinsing processes, large losses occur in terms of paint or rinsing agent.

Furthermore, DE 82 31 663 U1 discloses a paint conveying tube in an atomizer, wherein a static mixer is arranged in the paint conveying tube. Even this known mixer, however, requires a relatively large overall length.

Reference is also made to DE 30 40 136 A1 and U.S. Pat. No. 4,614,440 concerning the prior art.

Finally, US 2004/0114461 A1 discloses a so-called lattice mixer, wherein a static mixer is used for mixing highly viscous liquids, for example in injection moulding machines. Hitherto, lattice mixers of this type have not been used in atomizers, however, because it has been assumed that such lattice mixers are only suitable for mixing highly viscous liquids.

Disclosed herein is a general technical teaching of using a different mixer type, namely a so-called lattice mixer that has numerous mixer elements are arranged intertwined in a lattice-like manner. Such lattice mixers are, for example, known from US 2004/0114461 A1, so that the contents of this document are incorporated by reference herein in their entirety, i.e., can be fully added to the present description with respect to the design and the functioning method of a lattice mixer.

A commonality of the mixer disclosed herein with conventional helical mixers is that both cases include static mixers. This means that the mixer itself does not have any movable parts, as the mixing is effected by means of the flow movement of the coating agent components to be mixed with one another.

The presently disclosed lattice mixer differs by contrast from the conventional helical mixers by means of the arrangement and shaping of the individual mixing elements. Thus, the conventionally used helical mixer has spiral mixing elements which spirally divert the coating agent flow, wherein the adjacent mixing elements in the direction of flow have opposing diversion directions in each case, as a result of which the mixing is effected. The lattice mixer disclosed herein by contrast may have elongated, straight, sharp-edged and rod-shaped mixing elements which consist of plastic and have an essentially rectangular cross section in each case. These mixing elements therefore effect turbulences in each case, which lead to an effective mixing of the coating agent components which are to be mixed together.

The individual mixing elements are here arranged intertwined in a lattice-like manner. In the preferred exemplary embodiment of the lattice mixer, a plurality of rod-shaped mixing elements are in each case arranged together in one plane and thus form a lattice, wherein a plurality of lattices of this type made up of a plurality of mixing elements are arranged intertwined in a lattice-like manner.

Furthermore, the individual mixing elements preferably have a pitch angle relative to the direction of flow.

This means that the individual mixing elements are not aligned parallel to the direction of flow, as this would only lead to a low mixing action. Preferably, the pitch angle of the mixing elements to the direction of flow is greater than 20°, 30° or 40° and/or smaller than 70°, 60° or 50°. In one exemplary embodiment, the pitch angle for all mixing elements is essentially the same. As an alternative, however, it is also possible that the mixing elements have different pitch angles.

Further, the mixer may have a plurality of sections which are arranged one behind the other in the direction of flow and through which the flow successively passes. The various sections can for example differ by means of the orientation of the mixing elements. Thus, for example, the pitch angle of the mixing elements can fluctuate relative to the direction of flow between the sections. The mixer in total may have more than 5, 6, 7, 8, 9, 10, or even more than 11, different sections. Here, there is the option that the directly adjacent sections of the mixer are configured differently in each case, for example with regards to the pitch angle or the orientation and shaping of the mixing elements, wherein the next-but-one section of the mixer has the same structure again in each case.

Furthermore, the mixer may be elongated in the direction of flow and may have an essentially cylindrical cross section, wherein the mixer may be arranged completely within the atomizer.

Furthermore, the mixer may have an overall length in the direction of flow which is smaller than 10 cm, 8 cm or even 6 cm. This advantageously enables the arrangement of the mixer completely in the paint tube of the atomizer. The overall length of the mixer is therefore smaller than the overall length of the paint tube of the atomizer.

The presently disclosed atomizer may have a controllable main needle valve which optionally allows or blocks the coating agent flow. In the case of a closed main needle valve, the atomizer therefore does not apply any coating agent, so that the valve position of the main needle valve determines whether the atomizer applies the coating agent or not. The mixer is here arranged upstream of the main needle valve, so that the ready mixed coating agent is present at the main needle valve. Here, it is advantageous if the mixer is displaced as far as possible upstream towards the main needle valve in order to minimise the distance between the downstream end of the mixer and the main needle valve. This is advantageous, because as a result, the paint or solvent consumption is reduced in the case of a colour change or in the case of rinsing. The line length between the downstream end of the mixer and the main needle valve therefore may be shorter than 10 cm, 6 cm, 5 cm, 4 cm, 3 cm, 2 cm, or even shorter than 1 cm.

It has previously already been mentioned that the presently disclosed atomizer—may have a hollow paint tube in order to supply the coating agent to be applied. The advantages of the lattice mixer according to the invention here offer the option of arranging the mixer completely in the paint tube, so that under certain circumstances, it is possible to dispense with an additional mixer in the connection block of the atomizer, which was necessary in the conventional atomizer described above. Further, the paint tube can also form the casing of the conventionally cylindrical mixer, so that it is possible to dispense with an additional mixing tube for the encasing of the mixer. Furthermore, the diameter of the mixer may essentially correspond to the diameter of the paint tube, so that the mixer fills the cross section of the paint tube completely. However, there is also the option for a plurality of mixers to be arranged next to one another in the paint tube of the atomizer, which is described in detail below.

This makes sense for example if the atomizer is suitable for application of various paint systems, wherein each of the two paint systems has a plurality of components, particularly a base paint and a hardener. A mixer can then be assigned to each of the two paint systems, in order to mix the components of the paint system with one another.

Further, there is the option—as already mentioned briefly above—for the mixers for the various paint systems to be arranged together in the paint tube, wherein the mixers for the various paint systems may be located next to one another with respect to the direction of flow. Each mixer for the various paint systems here only fills part of the cross section of the paint tube. Furthermore, the various mixers then may be encased by one mixing tube in each case, in order to separate the various mixers from one another.

Further, it is to be mentioned that the mixers for the various paint systems have different mixing characteristics which are adapted to the properties of the respective paint system, in order to achieve a mixing result which is as optimal as possible.

Alternatively, there is also the possibility that the mixers for the various paint systems are not arranged together in the paint tube. Thus, the mixer for one paint system can be arranged in the paint tube, whilst the mixer for the other paint system is located outside of the paint tube, for example in a valve block or connection block of the atomizer upstream of the paint tube.

Generally, it is to be mentioned that the atomizer according to the invention can have a plurality of mixers, which can also generally help to optimize the mixing result.

In addition, a lattice mixer may include a plurality of mixing elements intertwined in a lattice-like manner for mixing a plurality of components of a coating agent in an atomizer, particularly in a rotary atomizer.

Figure 2:
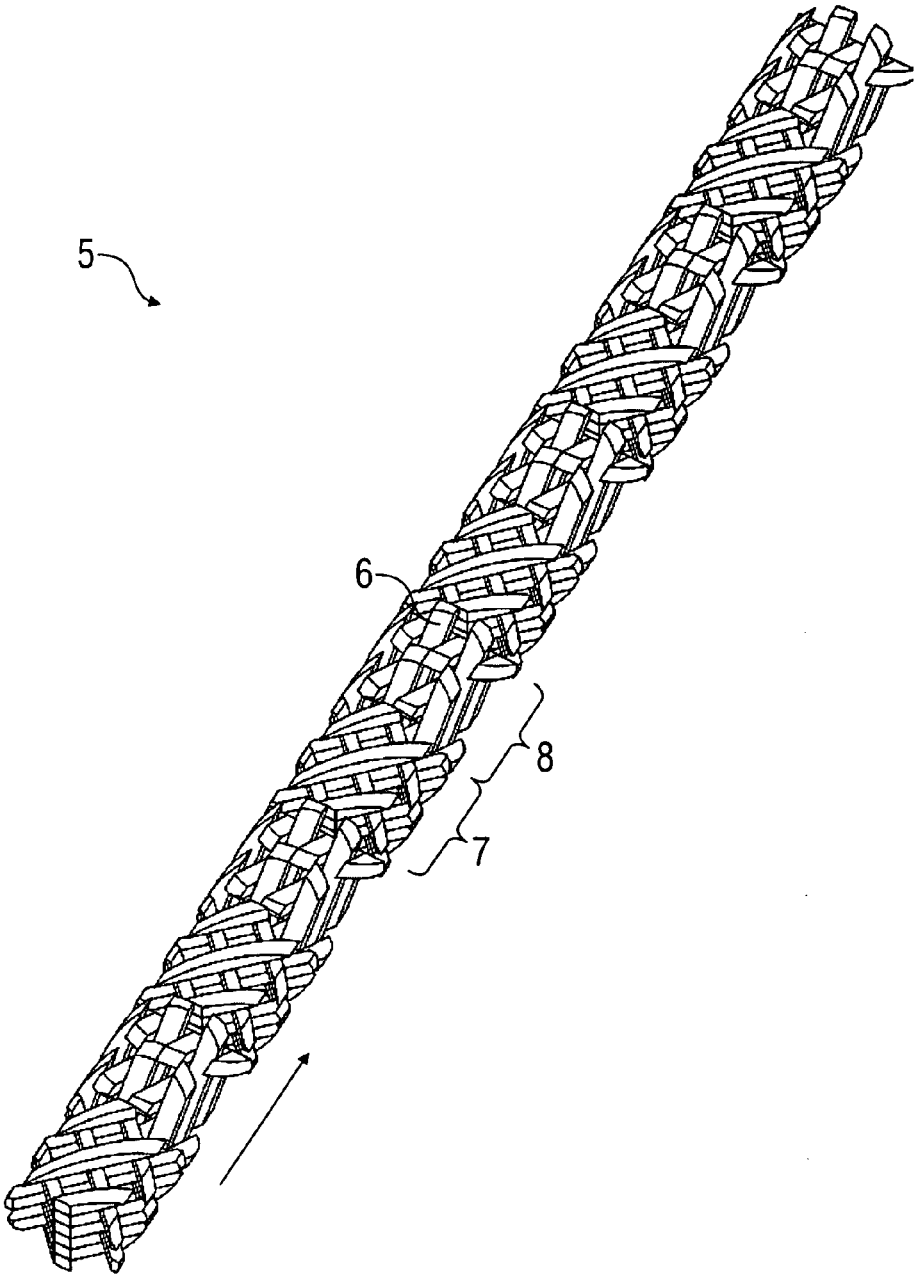
Figure 3:
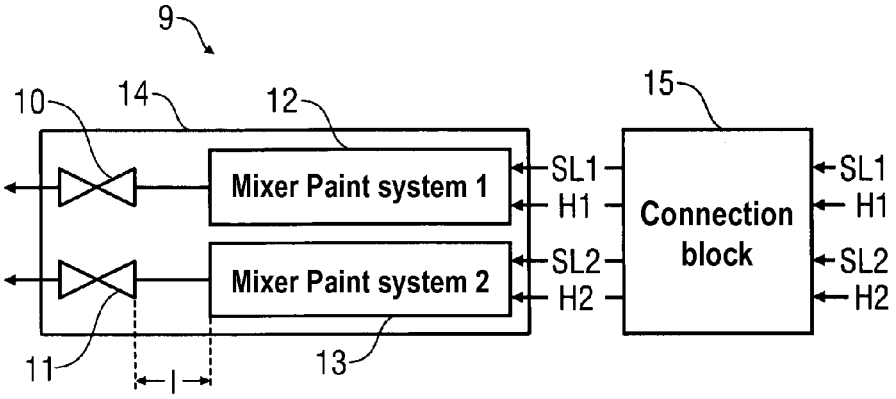
Figure 4:
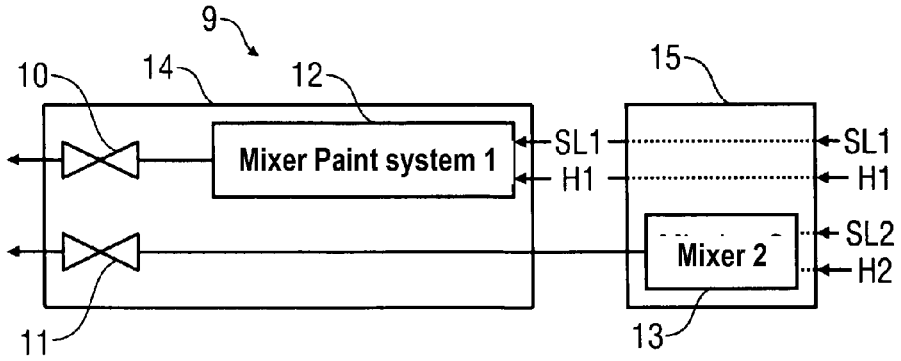

Other advantageous further developments of the disclosed lattice mixer are identified in the dependent claims or are explained in greater detail below with reference to the figures together with the description of the preferred exemplary embodiments of the invention. The figures show as follows:

FIG. 1: a schematic cross section drawing of a rotary atomizer with an integrated lattice mixer, FIG. 2: a perspective view of the lattice mixer from the rotary atomizer according to FIG. 1, FIG. 3: a simplified diagram for clarifying the structure of a rotary atomizer for the application of two different paint systems, wherein two mixers are integrated into the paint tube of the rotary atomizer, FIG. 4: a modification of FIG. 3, wherein the one mixer is arranged in the paint tube whilst the other mixer is located in the valve block.

FIG. 1 shows a rotary atomizer 1 that can be used for example for the painting of motor vehicle body components, wherein the rotary atomizer 1 is structured substantially conventionally, so that it is possible to dispense with a detailed description of the structure and the functioning of the rotary atomizer 1. For the present disclosure, it is merely important that the rotary atomizer 1 has a paint tube 2 which is fixed on a connection block 3, wherein the paint tube 2 is aligned coaxially to the axis of rotation of a bell cup shaft 4, in order to supply the coating agent to be applied.

A lattice mixer 5 may be arranged in the paint tube 2, in order to mix the various components (e.g. base paint and hardener) of the coating agent with one another.

The lattice mixer 5 has numerous elongated, rod-shaped, sharp-edged mixing elements 6 which are arranged intertwined in a lattice-like manner, wherein the mixing elements 6 generate turbulences in the paint tube 2, which leads to good mixing.

The lattice mixer shown here consists of a total of twelve sections 7, 8, which are arranged one behind the other in the direction of flow and through which the flow successively passes. The various sections 7, 8 of the lattice mixer 5 differ here by means of the orientation of the individual mixing elements 6, as can be seen from the perspective illustration in FIG. 2.

FIG. 3 shows a schematic diagram for clarifying the structure of a rotary atomizer 9 that is suitable for the application of two different paint systems, wherein the first paint system consists of a first base paint SL1 and a first hardener H1, whilst the second paint system consists of a second base paint SL2 and a second hardener H2.

For the application of the various paint systems, the rotary atomizer has two main needle valves 10, 11, and also a lattice mixer 12, 13 in each case, wherein the two lattice mixers 12, 13 are arranged together adjacently in a paint tube 14 of the rotary atomizer 9. The lattice mixer 12 here mixes the first base paint SL1 with the first hardener H1, whilst the other lattice mixer 13 mixes the second base paint SL2 with the second hardener H2.

The two lattice mixers 12, 13 here correspond in terms of structure and function to the lattice mixer 5 according to FIGS. 1 and 2.

Furthermore, the rotary atomizer 9 also has a connection block 15 with integrated valves in this exemplary embodiment.

It can furthermore be seen from the drawing that the two lattice mixers 12, 13 are arranged at a very short spacing 1-5 cm upstream of the associated main needle valves 10, 11. This is advantageous, because the line section to be rinsed between the lattice mixers 12, 13 and the associated main needle valves 10, 11 has a small volume as a result, so that the rinsing agent losses or the paint losses are also correspondingly small.

FIG. 4 shows a modification to the exemplary embodiment in FIG. 3, so that reference is made to the above description to avoid repetition, wherein the same reference numerals are used for corresponding details.

A particular feature of this exemplary embodiment consists in the arrangement of the two lattice mixers 12, 13. Thus, the lattice mixer 12 is in this exemplary embodiment likewise located inside the paint tube 14, whereas the other lattice mixer 13 is integrated into the connection block 15.

The invention is not limited to the preferred exemplary embodiments described above. Instead, a plurality of variants and modifications are possible, which also make use of the concept of the invention and thus fall within the scope of protection. Furthermore, it is to be mentioned that the invention also claims protection for the subject of the dependent claims independently of the features of the preceding claims.

The invention claimed is:

1. An atomizer including a first and second controllable main needle valves, the position of the needle valve determinative of whether a coating agent is applied, the atomizer further comprising:

a first and second lattice mixer, positioned in a first and second coating lines respectively, upstream of the first and second needle valves and configured to mix components of a coating agent with one another in the respective coating lines, with the first lattice mixer positioned adjacent to the first needle valve;

wherein the first and second mixers each having mixing elements that are arranged intertwined in a lattice-like manner;

each mixer has a plurality of sections linearly connected one behind the other in a direction of flow and through which the flow successively passes, each of the mixer sections including a plurality of the mixing elements; and the mixing elements in adjacent sections of the mixer in the direction of flow are aligned differently from one another.

2. The atomizer of claim 1, wherein the mixing elements each have an essentially rectangular cross section and are elongated.

3. The atomizer of claim 2, wherein the individual mixing elements are each straight, sharp-edged, rod-shaped, and plastic.

4. The atomizer of claim 1, wherein the individual mixing elements have a pitch angle relative to the direction of flow.

5. The atomizer of claim 1, wherein the pitch angles for all mixing elements are essentially equal to one another.

6. The atomizer of claim 1, wherein the mixer includes more than five sections.

7. The atomizer of claim 1, wherein the mixer is elongated in the direction of flow, essentially cylindrical, and has an overall length of less than 10 centimeters.

8. The atomizer of claim 1, wherein the mixer is arranged completely within the atomizer.

9. The atomizer of claim 1, wherein the mixer is arranged completely in the paint tube, the mixing elements are arranged without an additional mixing tube in the paint tube, and a diameter of the mixer essentially corresponds to a diameter of the paint tube, so that the mixer fills the cross section of the paint tube substantially completely.

10. The atomizer of claim 1, wherein the atomizer is suitable for application of at least two different paint systems, wherein each of the two paint systems has a plurality of components, and the atomizer for each of the different paint systems has a mixer, wherein the mixers are constructionally integrated into the atomizer.

11. The atomizer of claim 10, wherein the mixers for the different paint systems are arranged together in the paint tube, are arranged adjacently with respect to the direction of flow, fill only part of the cross section of the paint tube, have a mixing tube in which the mixing elements are arranged, wherein the mixing tubes separate the mixers from one another, and have different mixing properties, the mixing properties being adapted to the properties of a respective one of the different paint systems.

12. The atomizer of claim 10, wherein the mixer for one of the different paint systems is arranged in the paint tube, while the mixer for another of the different paint systems is located outside of the paint tube.

13. The atomizer of claim 1, wherein a plurality of mixers are arranged in the atomizer.

14. The atomizer of claim 1, wherein the mixing elements have a pitch angle and the pitch angle of the mixing elements is greater than 20 degrees and smaller than 70 degrees.

15. The atomizer of claim 14, wherein the length of the coating line that lies between the end of each mixer closest to its respective main needle valve is shorter than 10 centimeters.

* * * * *